US005916337A

United States Patent [19]

Caniglia et al.

[11] Patent Number: 5,916,337

[45] Date of Patent: Jun. 29, 1999

[54] EASY PULL RING FOR POP-TOP AND PULL-TOP CANS

[76] Inventors: Joseph E. Caniglia; Robert G. Caniglia, both of 5368 E. 134th St., Garfield Heights, Ohio 44125

[21] Appl. No.: 08/922,226

[22] Filed: Sep. 2, 1997

[51] Int. Cl.[6] ..... B67B 7/44

[52] U.S. Cl. ..... 81/3.15; 81/3.55; 220/269

[58] Field of Search ..... 81/3.07, 3.15, 81/3.35, 3.55; 220/269, 270, 274

[56] References Cited

U.S. PATENT DOCUMENTS

| | | | |
|---|---|---|---|
| 1,218,884 | 3/1917 | Morgan | 81/3.15 X |
| 1,963,007 | 3/1934 | Week | 81/3.55 |
| 3,337,085 | 8/1967 | Bozek . | |
| 3,370,169 | 2/1968 | Bozek . | |
| 4,046,283 | 9/1977 | Lockwood . | |
| 4,817,816 | 4/1989 | Leseman et al. . | |
| 5,497,896 | 3/1996 | Shand . | |
| 5,699,928 | 12/1997 | Chung et al. | 81/3.15 X |

*Primary Examiner*—James G. Smith

*Attorney, Agent, or Firm*—Renner, Otto, Boisselle & Sklar, PLL

[57] ABSTRACT

A pull ring to facilitate opening of pop-top or pull-top cans. The pull ring consists of a flat portion with two attached arms. The two arms defining an opening large enough to accommodate entry of a portion of the tab of the closure of the pull-top or pop-top can. The two arms and the flat portion define a aperture in communication with the opening which is large enough to contain the handle portion of the tab. The ring has one or more protrusions on the arms, opposite the flat portion, to aid gripping. The ring is movable from a down position, where it protrudes minimally from the can surface, to a deployed position, where it remains in place by means of a flat outer surface of the flat portion resting on the can's surface.

10 Claims, 1 Drawing Sheet

EASY PULL RING FOR POP-TOP AND PULL-TOP CANS

BACKGROUND OF THE INVENTION

Cans with pop-top closures have been on the market for a number of years. They have been widely used for beverage cans, and have also been used for other applications, such as medications and lubricants. Such a closure design involves a knock out portion, which is severed along a scored line as the can is opened, except for a hinged portion which remains attached to the can. The partial severing of the knock-out portion is accomplished by lifting a tab which is attached to the can close to the knock-out portion by means of a rivet. The tab is initially in a horizontal position, resting against the top of the can. During the opening process it is lifted to a vertical position, opening the knock-out portion. Then it is pushed back to the horizontal position so that it does not interfere with the pouring or drinking of the contents of the can. This design has the advantage of being openable without use of tools. It also does not involve any detachable pieces which could possibly inflict injuries or cause environmental problems.

Some cans containing non-liquid foods employ pull-top closures. Examples of foods with pull-top closures include stews, soups, and pet foods. The pull top closure design involves a lid which encompasses substantially all of the top of a can. A tab, similar to the tabs used with pop-top enclosures, is attached to one end of the lid with a rivet and is initially in a horizontal position. As the tab is lifted to a vertical position, the lid is partially severed along a scored line which encircles the lid. The tab is then pull upward, thereby completely severing the lid along a scored line. This design also has the advantage of not requiring any tools for opening the can.

Although present pop-top and pull-top can designs have the foregoing advantages, they suffer from disadvantages as well. The tabs of the present designs are difficult to pry up from the surface of the can when in their initial horizontal position. This is a problem particularly for people with long fingernails that can crack or break if subjected to stress. In addition, some people find it difficult to exert sufficient leverage to partially sever the knock-out portion of a pop-top closure or the lid of pull-top closure.

Many approaches have been taken to simplify the process of opening pop-top cans. Separate tools have been developed which can be inserted under the tab for the purpose of prying the tab up. Examples of such separate tools are U.S. Pat. No. 4,681,358, issued to Smith, and U.S. Pat. No. 4,873,896, issued to Hull. However, such tools are too expensive to make disposal after a single use economical. Moreover, these separate tools are too bulky and too expensive to be packaged with cans.

In addition, variations on the can closure design have been developed. For example, U.S. Pat. No. 5,248,053, issued to Lundgren, discloses a variation of the conventional design where the tab pivots on an inclined plane such that when it is rotated the end of the tab is raised from the top of the can for easier access by the user. Another example is U.S. Pat. No. 5,497,896, issued to Shand, which discloses a tab design with a member that can be extended beyond the rim of the can for easier access and increased leverage. However, these proposed changes would add to the complexity of can closure designs, and would involve changes in the manufacturing process of cans.

As can be seen from the foregoing discussion, there still exists a need for a container opening device that is simple and economical, which can be employed without requiring changes to present can designs, and that is compact enough to be installed on cans without affecting the stackability of cans.

SUMMARY OF THE INVENTION

Accordingly, one aspect of the present invention is to provide a pull ring to facilitate opening of pop-top and pull-top cans which have tabs attached to closure members.

In accordance with another aspect of the invention, the pull ring has a flat portion with a flat outer surface; first and second arms each having first and second ends, the first ends of the arms attached to the flat portion, the second ends of the arms defining an opening opposite the flat portion large enough to permit entry of the attached tab, the flat portion and the arms further defining an aperture in communication with the opening. At least one of the arms can pass through the hole in the tab for installation on the tab, the pull ring when installed on the tab being movable to a deployed position where the flat outer surface rests on the can.

In accordance with another aspect of the invention, the pull ring also has a protrusion attached to the second end of one of the arms. The protrusion can comprise a bead of metal.

In accordance with yet another aspect of the invention, the pull ring has protrusions attached to the second end of both arms. The protrusions can be formed by folding back the material at the second end of each arm.

In a further aspect of the invention the arms are curved, thereby creating an aperture that is substantially circular in shape.

DETAILED DESCRIPTION OF THE INVENTION

Figure 1:
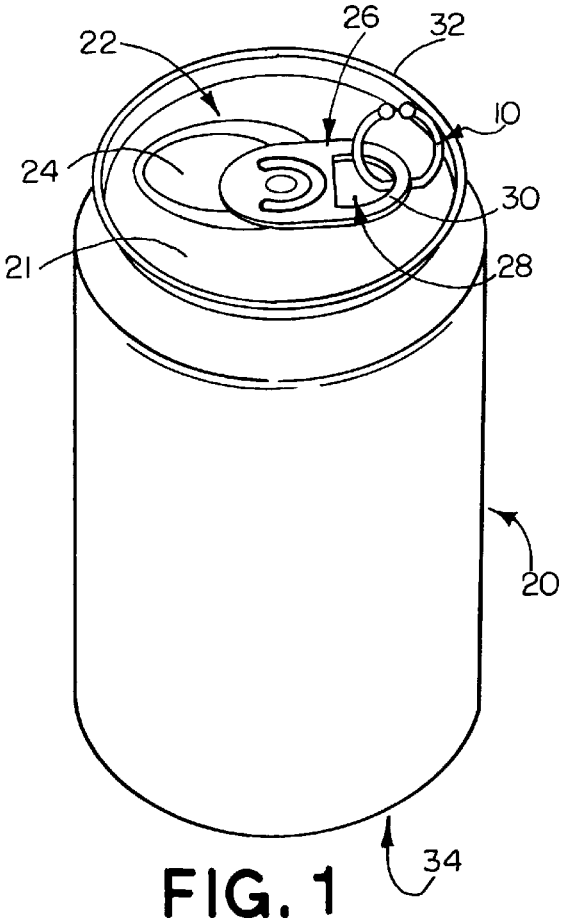
FIG. 1 is a perspective view of a pop-top can with a pull ring of the present invention installed.

Referring to the drawings, where like numerals denote like items, and initially to FIG. 1, a pull ring 10 of the present invention is shown connected to the top of a can 20. The can has top surface 21 with a closure 22 with a knock-out portion 24. A fixed tab 26 is attached to the knock-out portion. The tab 26 has a hole 28 therein to facilitate gripping of the tab at a handle portion 30 as the tab is pulled upward to push down the knock-out portion 24, thereby opening the can.

The can includes a top circumferential lip 32 which, in conjunction with a smaller-diameter bottom circumferential lip 34 of another like can, allows like cans to be stacked atop each other. The can 20 has a recess at its bottom (not shown). This recess accommodates the closure 22 at top surface 21 of another can which is stacked below.

Figure 2:
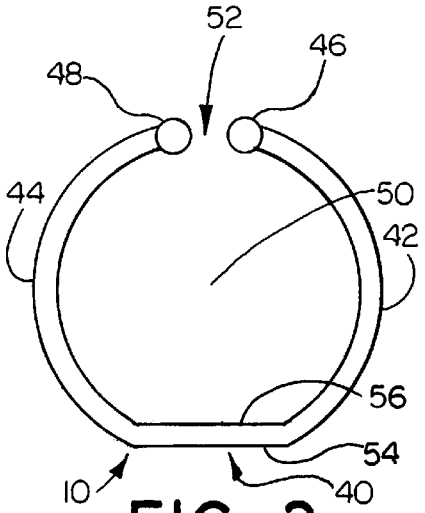
FIG. 2 is a side view of a pull ring constructed in accordance with the present invention.

Referring now to FIG. 2, the pull ring 10 comprises a flat portion 40 and a pair of arms 42 and 44 attached to the flat portion. Each arm is small enough to pass through hole 28 of tab 26 so that the pull ring can be installed on the tab.

The flat portion and the arms together define an aperture 50 which is large enough contain the handle portion 30 of tab 26. The aperture preferably has a rounded shape where the arms attach to the flat portion, thereby allowing for easy installation of the pull ring on the tab. However, the aperture could be any shape.

The aperture is in communication with an opening 52 which likewise is large enough to allow the handle portion of the tab to pass through it. It will be appreciated that the arms could be made such that they function as springs to keep the opening 52 closed except when forced open by having the handle portion pushed through. Additionally, opening 52 could be closed after installation of the ring on tab 26, thereby ensuring that the ring remains available on the tab for opening and does not have the potential of later becoming a separate piece of litter.

The pull ring is preferably made of metal, but could be made of any strong, material. Preferably the pull ring has resiliency characteristics, as in mentioned above.

Figure 3:
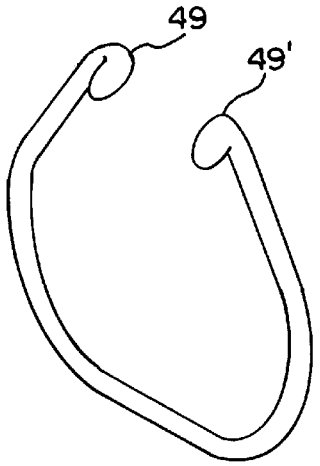
FIG. 3 is a perspective view of an alternate embodiment of the pull ring, with protrusions created by folding over the ends of the arms.

The arms 42 and 44 have protrusions 46 and 48 on their ends. The protrusions 46 and 48 aid gripping of the pull ring. Although gripping is often facilitated by the use of two protrusions, one at the end of each arm, a single protrusion will in some instances provide a satisfactory grip. Where the aperture is large enough, protrusions may be unnecessary. If the ring is made of metal the protrusions can be made in a variety of ways. For example, the ends of the metal arms could be folded over forming protrusions 49 and 49' (FIG. 3), or a bead of solder could be applied to the ends of the arms. The protrusions will generally be small in size in order to conserve on materials and to minimize the projection of the pull ring from the top of the can 20 when the pull ring is in the folded down position.

Figure 4:
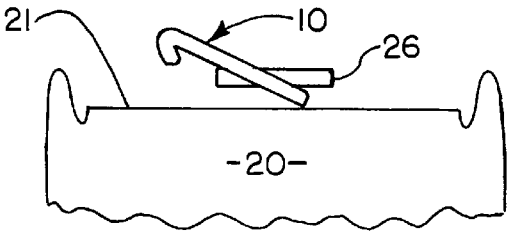
FIG. 4 is a side view of a pop-top can with a pull ring installed and in the down position.
Figure 5:
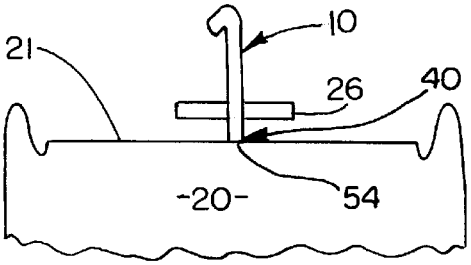
FIG. 5 is a side view of a pop-top can with a pull ring installed and in the deployed position.

When the pull ring is installed but not in use it can be left in a down position (FIG. 4). While in the down position the pull ring projects only minimally above the top of the tab 26. Even in the down position, however, the pull ring can be more easily grasped than can the tab of a pop-top can. This is for several reasons: (1) the pull ring projects somewhat above the tab 26. The pull ring may be in a deployed position (FIG. 5) where a flat outer surface 54 of the flat portion 40 rests against the top surface of the can, with the protrusions well above the top surface 21 of the can. The flat outer surface of the flat portion in contact with the top surface allows the pull ring to stay in the deployed position without being held in place.

The flat portion and the arms are preferably substantially coplanar and made of a thin material, thereby minimizing the projection of the pull ring above the top surface of the can when the pull ring is in the down position. The flat portion 40 has a straight inner surface 56 (see FIG. 2).

When the pull ring 10 is in the deployed position it allows the closure 22 to be opened without the difficulties inherent in opening the closure when no ring is employed. The pull ring increases the distance between the attachment point of tab 26 to knock-out portion 24 and the grip point of the user. This increased distance means that less force is needed to open the closure throughout the opening process.

The pull ring provides a convenient, sure grip away from the surface of the top of the can 20. With the pull ring, there is no need to pry the handle portion 30 of the tab 26 up with a fingernail or finger tip in order to start opening the can, as is required when the pull ring is not installed. Since this prying is the most difficult step in opening a pop top can, it can be seen that the increased access and increased leverage accorded the user by the present invention greatly facilitates opening of pop top cans. Moreover, the present invention accomplishes this without interfering with the stacking, storage, packaging, or shipping methods involved with cans of present designs the pull ring can be maintained in its folded-down position except when being used for opening cans.

I claim:

1. A pull ring for opening a closure member of a can, the closure member having an attached tab with a hole therein, the pull ring comprising:

a ring-like or loop-like body having an at least partially open end, the body including first and second arms and a flat portion, the flat portion and the arms being substantially coplanar, the first and second arms each having first and second ends, the first ends of the arms attached to the flat portion, the second ends of the arms defining an opening large enough to permit entry of the attached tab when the arms are resiliently pried apart, protrusions attached to the second end of each of the arms to aid in gripping the ring, the protrusions protruding out of the plane of the flat portion and the arms, the flat portion and the arms further defining a substantially circular aperture in communication with the opening;

wherein at least one of the arms can pass through the hole in the tab for installation on the tab, the pull ring when installed on the tab being movable between positions generally in parallel with a surface of the can for storage and generally upstanding relative to such surface to facilitate grasping of the pull ring and opening of the can.

2. The pull ring of claim 1, wherein the opening is closed after installation of the ring on the tab.

3. The pull ring of claim 1, wherein the flat portion has a straight inner surface and the aperture has a rounded shape where the arms attach to the flat portion, thereby facilitating installation of the pull ring on the tab.

4. A pull ring for opening a closure member of a can, the closure member having an attached tab with a hole therein, the pull ring comprising:

a flat portion with a flat outer surface for resting on a surface of the can;

first and second arms each having first and second ends, the first ends of the arms attached to the flat portion, the second ends of the arms defining an opening opposite the flat portion large enough to permit entry of the attached tab, the flat portion and the arms further defining an aperture in communication with the opening; and a first protrusion attached to the second end of one of the arms to aid in gripping the ring;

wherein the flat portion and the arms are substantially coplanar and wherein the protrusion protrudes out of the plane of the flat portion and the arms, and where at least one of the arms can pass through the hole in the tab for installation on the tab, the pull ring when installed on the tab being movable to a deployed position where the flat outer surface rests on the can.

5. The pull ring of claim 4, wherein the first protrusion is formed by folding back material at the second end of the one of the arms.

6. The pull ring of claim 4, wherein the first protrusion includes a bead of metal.

7. The pull ring of claim 4, wherein the arms are curved, thereby defining an aperture that is substantially circular in shape.

8. The pull ring of claim 4, further comprising a second protrusion attached to the second end of the other of the arms to further aid in gripping the ring.

9. The pull ring of claim 4, wherein the flat portion has a flat inner surface and wherein the aperture has a rounded shape where the arms attach to the flat portion, thereby facilitating installation of the pull ring on the tab.

10. The pull ring of claim 4, wherein the arms are made of a resilient material, and wherein the opening is large enough to permit entry of the tab only when the arms are resiliently pried apart.

* * * * *